US009274534B2

(12) United States Patent
Fang et al.

(10) Patent No.: US 9,274,534 B2
(45) Date of Patent: Mar. 1, 2016

(54) FEED-FORWARD COMPENSATION FOR LOW-DROPOUT VOLTAGE REGULATOR

(71) Applicants: Emerson S. Fang, Fremont, CA (US); Alvin Leng Sun Loke, Fort Collins, CO (US)

(72) Inventors: Emerson S. Fang, Fremont, CA (US); Alvin Leng Sun Loke, Fort Collins, CO (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 300 days.

(21) Appl. No.: 13/723,780

(22) Filed: Dec. 21, 2012

(65) Prior Publication Data

US 2014/0176098 A1 Jun. 26, 2014

(51) Int. Cl.

| | |
|---|---|
| ***G05F 1/56*** | (2006.01) |
| ***G05F 1/46*** | (2006.01) |
| *G05F 1/575* | (2006.01) |

(52) U.S. Cl.

CPC ..... *G05F 1/46* (2013.01)

(58) Field of Classification Search

USPC ..... 323/280–290, 351

See application file for complete search history.

(56) References Cited

U.S. PATENT DOCUMENTS

| | | | | |
|---|---|---|---|---|
| 4,667,279 | A * | 5/1987 | Maier | 363/46 |
| 5,668,464 | A * | 9/1997 | Krein et al. | 323/259 |
| 5,859,725 | A * | 1/1999 | Sugiya et al. | 359/337.13 |
| 5,929,692 | A * | 7/1999 | Carsten | 327/531 |
| 6,208,206 | B1 * | 3/2001 | Leung et al. | 330/107 |
| 6,661,683 | B2 * | 12/2003 | Botker et al. | 363/60 |
| 6,975,099 | B2 * | 12/2005 | Wu et al. | 323/280 |
| 7,030,596 | B1 * | 4/2006 | Salerno et al. | 323/282 |
| 7,375,992 | B2 * | 5/2008 | Mok et al. | 363/60 |
| 7,495,422 | B2 * | 2/2009 | Mok et al. | 323/280 |
| 7,843,447 | B2 * | 11/2010 | Okuno | 345/212 |
| 7,893,670 | B2 * | 2/2011 | Pulijala et al. | 323/273 |
| 8,574,621 | B2 * | 11/2013 | Toshimitsu et al. | 424/448 |
| 2001/0024140 | A1 * | 9/2001 | Taylor | 330/292 |
| 2004/0022077 | A1 * | 2/2004 | Steigerwald et al. | 363/39 |
| 2004/0169550 | A1 * | 9/2004 | Perrier et al. | 327/541 |
| 2006/0043942 | A1 * | 3/2006 | Cohen | 323/207 |
| 2006/0055383 | A1 * | 3/2006 | Eberlein | 323/280 |
| 2008/0205095 | A1 * | 8/2008 | Pinon et al. | 363/39 |
| 2009/0079406 | A1 * | 3/2009 | Deng et al. | 323/280 |
| 2013/0029267 | A1 * | 1/2013 | Sugasaki | 430/281.1 |
| 2013/0033244 | A1 * | 2/2013 | Ock | 323/280 |

* cited by examiner

*Primary Examiner* — Matthew Nguyen
*Assistant Examiner* — Nusrat Quddus

(57) ABSTRACT

A voltage regulator includes a pass element having a control input coupled to a control node and operable to generate an output voltage at an output node, a negative feedback amplifier operable to receive a reference voltage and the output voltage and generate a signal at the control node based on a difference between the reference voltage and the output voltage, and a noise cancellation circuit coupled to the control node and the output node and operable to generate a bias current at the control node based on the output voltage.

19 Claims, 6 Drawing Sheets

FEED-FORWARD COMPENSATION FOR LOW-DROPOUT VOLTAGE REGULATOR

BACKGROUND

The disclosed subject matter relates generally to voltage regulation and, more particularly, to feed-forward compensation for a low-dropout voltage regulator.

Voltage regulators are used to provide low noise power supplies for sensitive analog devices in an integrated circuit that is dominated by digital circuits that introduce significant amounts of supply noise. For example, a clock-and-data recovery (CDR) phase-locked-loop (PLL) loop may employ a voltage controlled oscillator that is powered by a voltage regulator. Noise in the voltage supply equates to frequency error and ultimately jitter in the generated clock signal.

A conventional low-dropout (LDO) voltage regulator 100 is shown in FIG. 1. The regulator 100 includes a negative feedback amplifier 105 that feeds a pass element 110 at a control node 112, $V_{mpg}$. The output of the pass element 110 drives a load 115 connected to an output node 120 at a predetermined voltage level ($V_{OUT}$). A feedback path is established through a voltage divider 125 including resistors 130, 135. A capacitor 140 is coupled between the output node 120 and ground to provide high frequency noise rejection. The negative feedback amplifier 105 tracks the difference between the output voltage and a reference voltage, $V_{REF}$, to control the pass element 110 to reduce the voltage error between the inputs of the negative feedback amplifier 105.

The power supply noise rejection ratio (PSRR) of the conventional LDO regulator 100 is shown in FIG. 2. At low noise frequencies, the negative feedback amplifier 105 can force $V_{OUT}$ to track the input reference $V_{REF}$. The DC supply rejection is limited by the gain of the feedback amplifier 105 and the differential output resistance of the pass element 110. Once the feedback amplifier 105 becomes bandwidth-limited (at a noise frequency of $f_1$), the PSRR begins to degrade as $V_{OUT}$ can no longer track $V_{REF}$. This degradation is manifested as a zero in the PSRR response. The PSRR continues to degrade with increasing noise frequency until a frequency $f_2$, where the decreasing impedance of the capacitor 140 begins to take effect. At this point, the PSRR improves as high-frequency supply noise at $V_{OUT}$ is attenuated by the capacitor 140.

LDO regulators are limited in supply rejection across a broad noise frequency bandwidth due to limitations in the bandwidth of the feedback amplifier 105, the feedback amplifier gain, the available area for the large capacitor 140 to suppress supply noise beyond feedback amplifier bandwidth, and the output resistance of the pass element.

This section of this document is intended to introduce various aspects of art that may be related to various aspects of the disclosed subject matter described and/or claimed below. This section provides background information to facilitate a better understanding of the various aspects of the disclosed subject matter. It should be understood that the statements in this section of this document are to be read in this light, and not as admissions of prior art. The disclosed subject matter is directed to overcoming, or at least reducing the effects of, one or more of the problems set forth above.

BRIEF SUMMARY OF EMBODIMENTS

The following presents a simplified summary of only some aspects of embodiments of the disclosed subject matter in order to provide a basic understanding of some aspects of the disclosed subject matter. This summary is not an exhaustive overview of the disclosed subject matter. It is not intended to identify key or critical elements of the disclosed subject matter or to delineate the scope of the disclosed subject matter. Its sole purpose is to present some concepts in a simplified form as a prelude to the more detailed description that is discussed later.

In some embodiments, a voltage regulator includes a pass element having a control input coupled to a control node and operable to generate an output voltage at an output node, a negative feedback amplifier operable to receive a reference voltage and the output voltage and generate a signal at the control node based on a difference between the reference voltage and the output voltage, and a noise cancellation circuit coupled to the control node and the output node and operable to generate a bias current at the control node based on the output voltage.

In some embodiments, a circuit includes a voltage controlled oscillator operable to generate a clock signal, a phase detector operable to determine a phase difference between a data signal and the clock signal and control a frequency of the clock signal generated by the voltage controlled oscillator based on the phase difference, and a voltage regulator operable to receive a supply voltage and generate an output voltage for powering the voltage controlled oscillator. The voltage regulator includes a pass element having a control input coupled to a control node and operable to generate an output voltage at an output node, a negative feedback amplifier operable to receive a reference voltage and the output voltage and generate a signal at the control node based on a difference between the reference voltage and the output voltage, and a noise cancellation circuit coupled to the control node and the output node and operable to generate a bias current at the control node based on the output voltage.

In some embodiments, a method includes enabling a pass element of a voltage regulator. The pass element has a control input coupled to a control node and is operable to generate an output voltage at an output node based on a supply voltage. A reference voltage and the output voltage is received and a signal is generated at the control node based on a difference between the reference voltage and the output voltage to control the pass element to generate the output voltage. A bias current is generated using a noise cancellation circuit having at least one variable resistor at the control node based on the supply voltage.

BRIEF DESCRIPTION OF THE SEVERAL VIEWS OF THE DRAWINGS

The disclosed subject matter will hereafter be described with reference to the accompanying drawings, wherein like reference numerals denote like elements, and.

Figure 1:
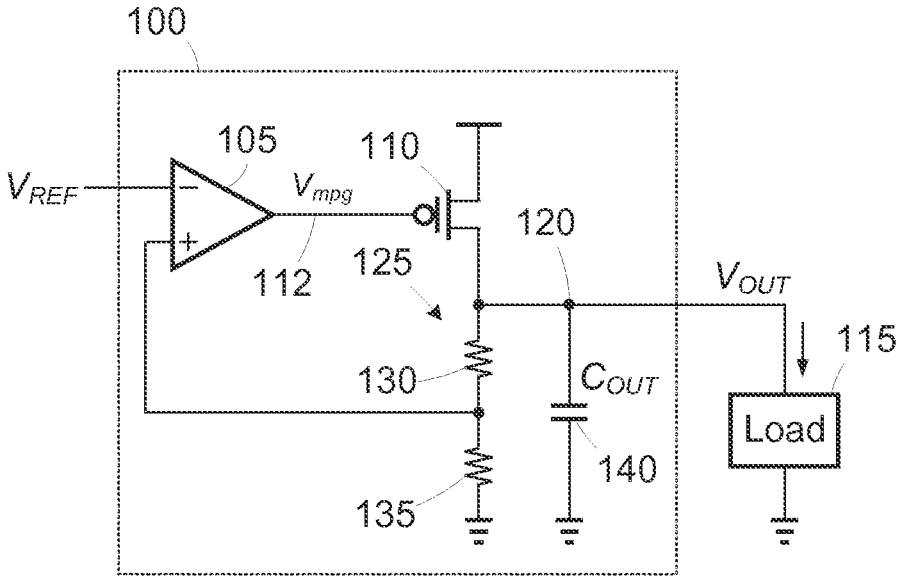
Figure 1 (Prior Art)
FIG. 1 is a circuit diagram of a conventional low-dropout (LDO) voltage regulator.
Figure 2:
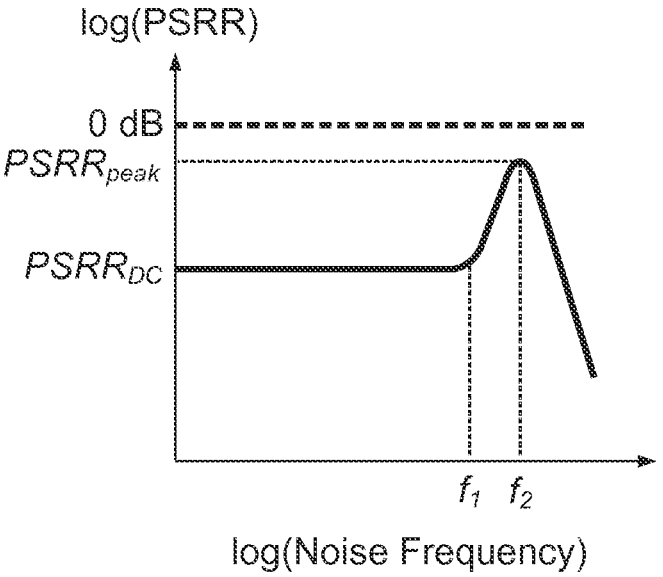
Figure 2 (Prior Art)
FIG. 2 is a diagram illustrating the power supply noise rejection ratio (PSRR) of the conventional LDO regulator of FIG. 1.

While the disclosed subject matter is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DETAILED DESCRIPTION

One or more specific embodiments of the disclosed subject matter will be described below. It is specifically intended that the disclosed subject matter not be limited to the embodiments and illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the disclosed subject matter unless explicitly indicated as being "critical" or "essential."

The disclosed subject matter will now be described with reference to the attached figures. Various structures, systems and devices are schematically depicted in the drawings for purposes of explanation only and so as to not obscure the disclosed subject matter with details that are well known to those skilled in the art. Nevertheless, the attached drawings are included to describe and explain illustrative examples of the disclosed subject matter. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 3:
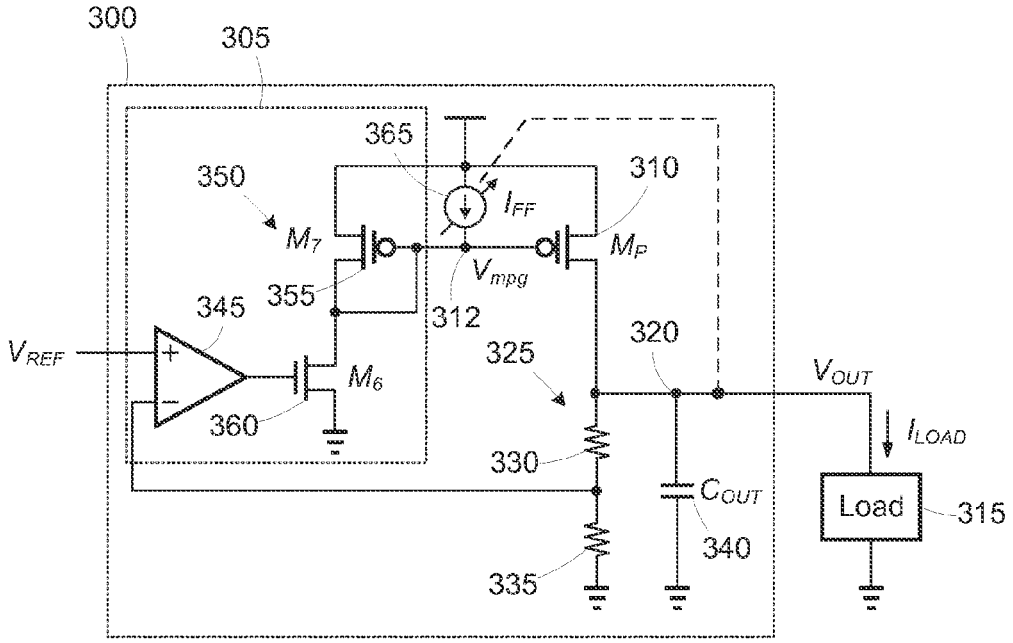
FIG. 3 is a circuit diagram of a feed-forward compensated voltage regulator, according to some embodiments.

Referring now to the drawings wherein like reference numbers correspond to similar components throughout the several views and, specifically, referring to FIG. 3, the disclosed subject matter shall be described in the context of a feed-forward compensated voltage regulator 300.

The regulator 300 includes a negative feedback amplifier 305 that feeds a pass element 310 at a control node 312, $V_{mpg}$. The output of the pass element 310 drives a load 315 connected to an output node 320 at a predetermined voltage level ($V_{OUT}$). A feedback path is established through a voltage divider 325 including resistors 330, 335. A capacitor 340 is coupled between the output node 320 and ground to provide high frequency noise rejection. The negative feedback amplifier 305 includes a differential amplifier stage 345 and a common source stage 350. The common source stage 350 includes transistors 355 and 360. A noise canceling circuit 365 operable to inject a compensation current into the control node 312 based on a sensed noise signal in the input voltage.

The common source stage 350 of the negative feedback amplifier 305 allows the feedback loop to be compensated for loop stability at the regulator output instead of at the control node 312. This arrangement enables the feedback loop to be stabilized without degrading the bandwidth of the differential amplifier stage 345. The common source stage 350 provides additional feedback loop gain through the transistors 355, 360 as well as through a current mirror defined by the transistor 355 and the pass element 310, where the current mirror multiplier ratio exceeds unity. Second, besides offering additional feedback loop gain, the common source stage 350 also provides an injection point for the noise canceling circuit 365 delivered to the control node 312 to adjust the control voltage of the pass element 310 and desensitize $V_{OUT}$ to the detected supply noise.

Figure 4:
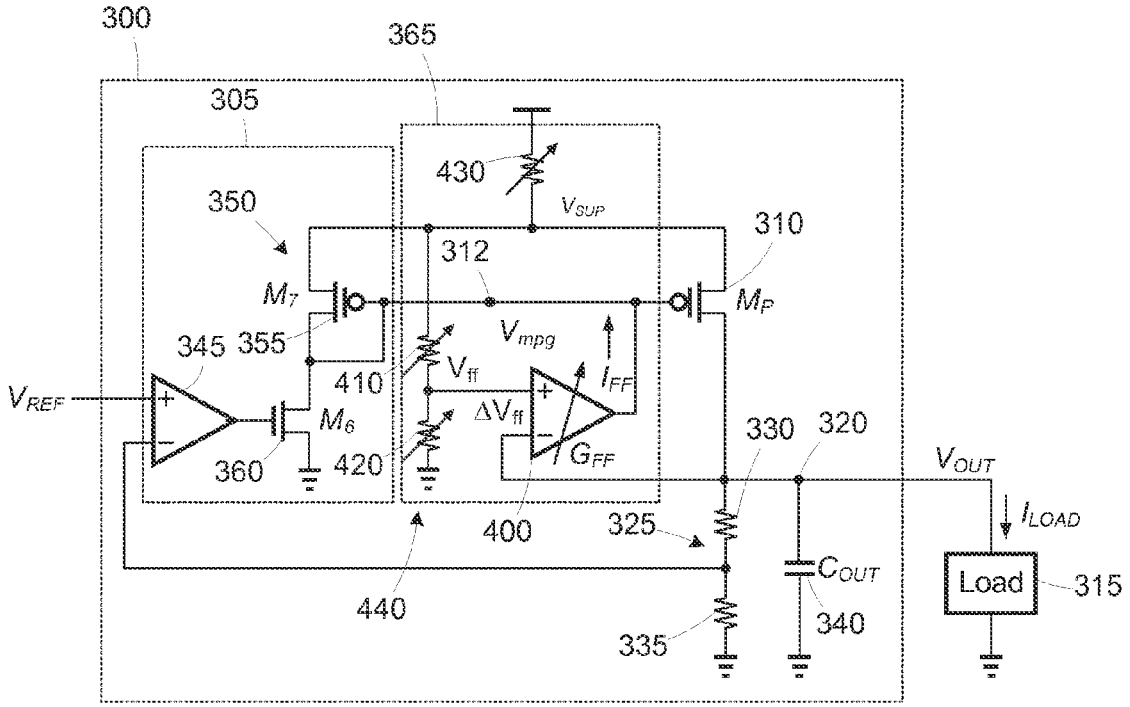
FIG. 4 is a circuit diagram illustrating one embodiment of the noise canceling circuit of FIG. 3, according to some embodiments.

FIG. 4 illustrates the noise canceling circuit 365 of FIG. 3, according to some embodiments. The noise canceling circuit 365 includes a variable transconductance feed-forward amplifier 400, variable tuning resistors 410, 420, and a variable calibration resistor 430. The noise-canceling signal is generated by the feed-forward amplifier 400 that senses supply noise voltage and converts this noise voltage to a noise-canceling current ($I_{FF}$) injected to the control node 312 ($V_{mpg}$). The feed-forward amplifier 400 is considered feed-forward in the respect that it provides a feed-forward signal based on the supply noise for compensating the output of the feedback amplifier 305. A positive noise voltage in the supply voltage, $V_{SUP}$, results in a positive value of $\Delta V_{ff}$, which generates a small positive $I_{FF}$ output from the feed-forward amplifier 400. This positive compensation causes a drop in the current provided by transistors 310 and 350 since the current through the transistor 360 is unchanged, resulting in an increase in $V_{mpg}$ and subsequent reduction in $V_{OUT}$ to compensate for the positive supply noise voltage. Similarly, a negative noise voltage in the supply voltage, $V_{SUP}$, results in a negative value of $\Delta V_{ff}$, which generates a negative $I_{FF}$ output from the feed-forward amplifier 400. This negative compensation causes an increase in the current provided by transistors 310 and 350, resulting in an increase in $V_{OUT}$ to compensate for the negative supply noise voltage.

The transconductance (voltage-to-current) gain of the feed-forward amplifier 400 ($G_{FF}$) may be calibrated digitally by inducing a droop in the supply using the variable calibration resistor to artificially inject a DC level of supply noise, sensing the voltage reduction in $V_{OUT}$, and adjusting the feed-forward amplifier gain to reduce/cancel the change in $V_{OUT}$ due to the supply droop.

In some embodiments, the feed-forward amplifier 400 consists of a differential source-degenerated amplifier. One amplifier input, $V_{FF}$, senses supply voltage noise through the voltage divider 440 formed by variable tuning resistors 410, 420, and the other input senses the voltage at the output node 320. This method of establishing $V_{ff}$ also enables the adjustment of the variable tuning resistors 410, 420 to remove the amplifier offset caused by random device variation in the feed-forward amplifier 400. The transconductance gain of the feed-forward amplifier 400 is determined by a variable source-degeneration resistance ($R_{FE}$) to produce the noise-canceling current $I_{FF}$.

Figure 5:
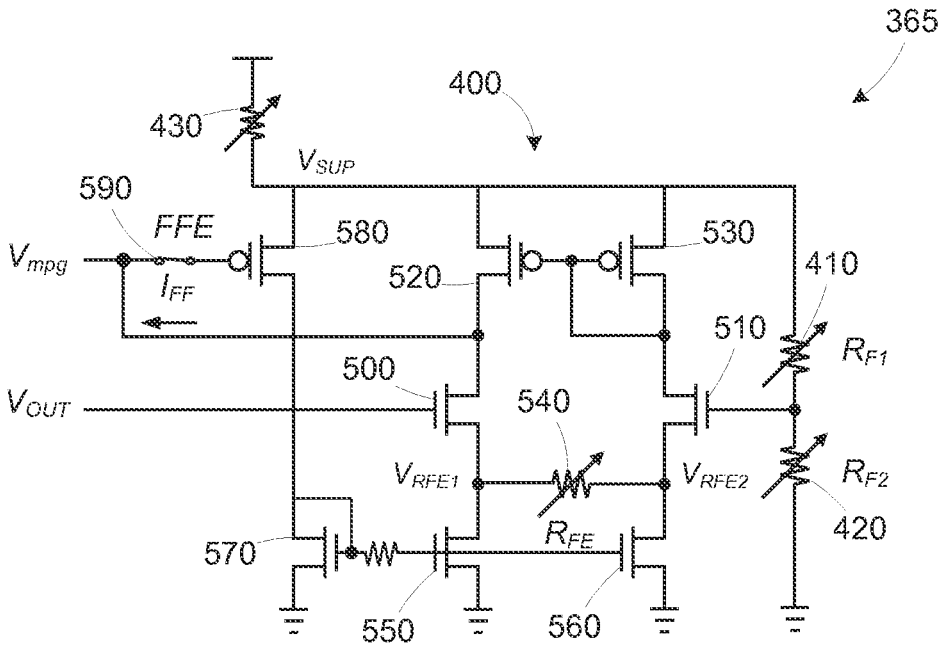
FIG. 5 is a circuit diagram circuit of the noise canceling circuit of FIG. 4 including a feed-forward amplifier 400, according to some embodiments.

A circuit diagram of the noise canceling circuit 365 including the feed-forward amplifier 400 is shown in FIG. 5, according to some embodiments. The feed-forward amplifier 400 includes a differential-input/single-ended-output transconductance amplifier that converts an input voltage difference (i.e., between $V_{ff}$ and $V_{OUT}$) into a single-ended output current, $I_{FF}$. The amplifier topology is a differential common-source amplifier with resistive source degeneration. The input transistors 500, 510 receive the input voltages $V_{OUT}$ and $V_{FF}$, respectively. Transistors 520, 530 make up the pull-up active current mirror loads for the transistors 500, 510, respectively. Resistor 540 ($R_{FE}$) represents the tunable source degeneration resistance that sets the transconductance gain ($G_{FF}$) of the amplifier 400. Transistors 550, 560 provide the current source biasing for the left and right legs of the differential amplifier 400, and receive their biasing from diode-connected transistor 570, which is biased by a reference current provided by mirroring off $V_{mpg}$ through the transistor 580. A switch 590 controlled by a feed-forward enable (FFE) signal is provided for enabling the noise canceling circuit 365.

Figure 6:
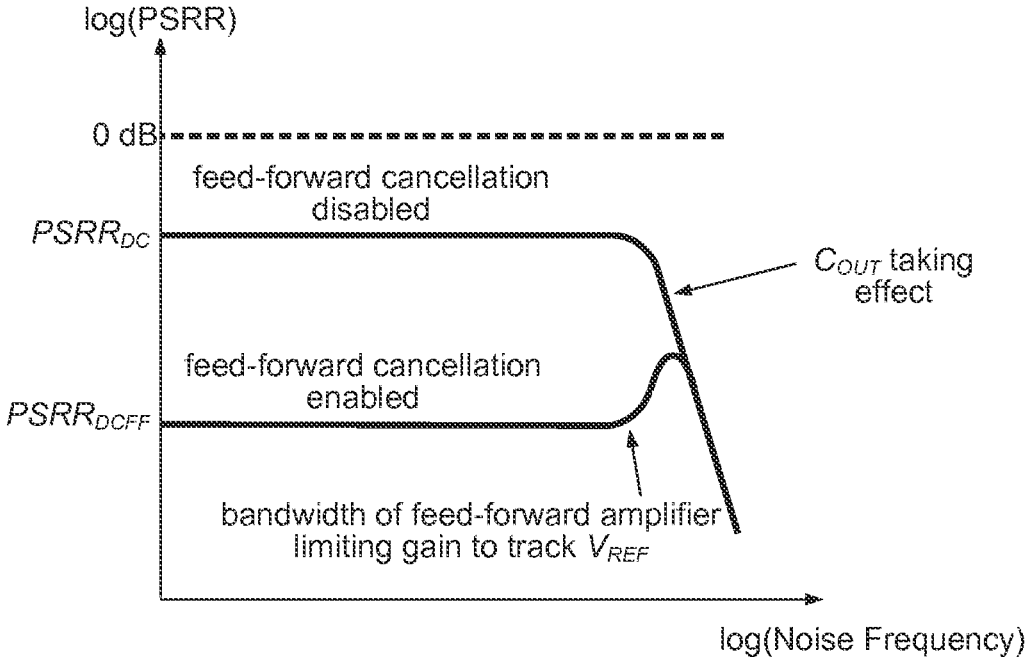
FIG. 6 is a diagram illustrating the power supply noise rejection ratio (PSRR) of the voltage regulator of FIG. 3, according to some embodiments.

The PSRR behavior of the regulator 300 is illustrated in FIG. 6, which shows the improvement in supply noise rejection provided by the feed-forward noise-canceling circuit 365.

Calibration of the regulator 300 is conducted by sensing the changes in the supply voltage, $V_{SUP}$. The variable resistor 430 may be used to inject perturbations into the supply voltage for determining the effects on the output voltage and configuring the variable elements. In some embodiments, a high-resolution analog-to-digital converter (ADC) may be used to measure $V_{OUT}$ to calibrate the regulator 300. The resolution required for the ADC increases as the level of desired PSRR improvement increases.

Figure 7:
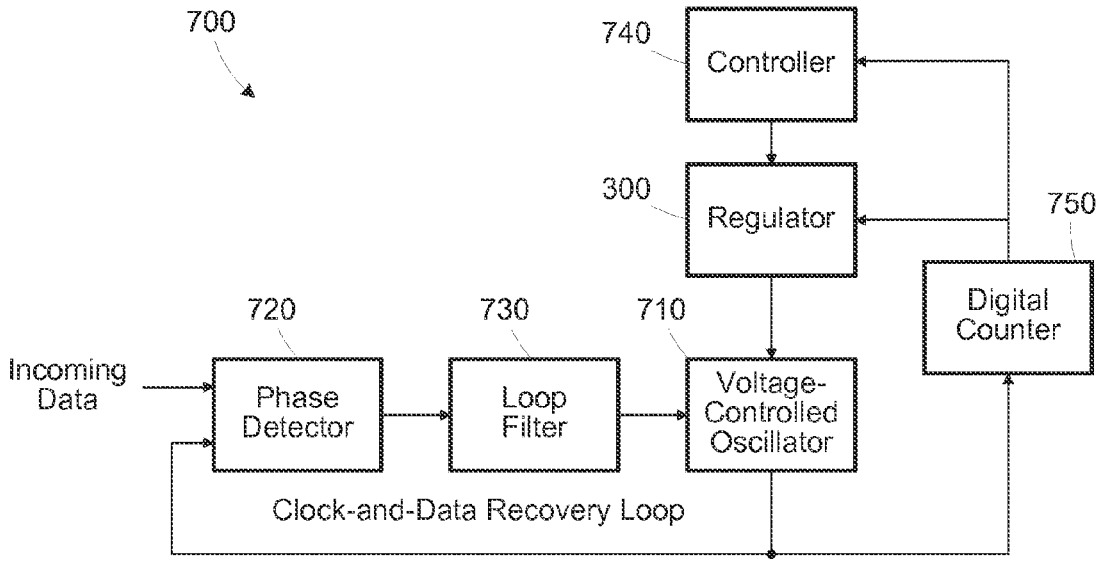
FIG. 7 is a simplified block diagram of a phase-locked loop (PLL) including the voltage regulator of FIG. 3, according to some embodiments.

As shown in FIG. 7, the regulator 300 may be used in a phase-locked-loop (PLL) circuit 700 to deliver a supply voltage to a voltage-controlled oscillator (VCO) 710. A clock-and-data recovery phase detector 720, such as an Alexander phase detector, measures phase error between signal transitions in the incoming data signal and the clock edges produced by the VCO 710. A loop filter 730 filters the error signal and controls the VCO 710 to reduce the error.

The intrinsic sensitivity of the frequency of the VCO 710 to $V_{OUT}$ is exploited to calibrate the regulator 300. The VCO frequency monotonically increases with increasing $V_{OUT}$. Hence, changes in $V_{OUT}$ are seen as frequency changes in the VCO output. Changes in the amplitude of $V_{OUT}$ are determined by counting the number of VCO clock cycles with a digital counter 740 over a given time window. The resolution of the measurement may be increased by extending the duration of the window to count more clock cycles. A digital calibration algorithm is employed by a controller 750 to determine the voltage divider ratio formed by resistors 410 and 420 ($R_{F1}$ and $R_{F2}$) and the transconductance gain ($G_{FF}$) set by the resistor 540 ($R_{FE}$).

Figure 8:
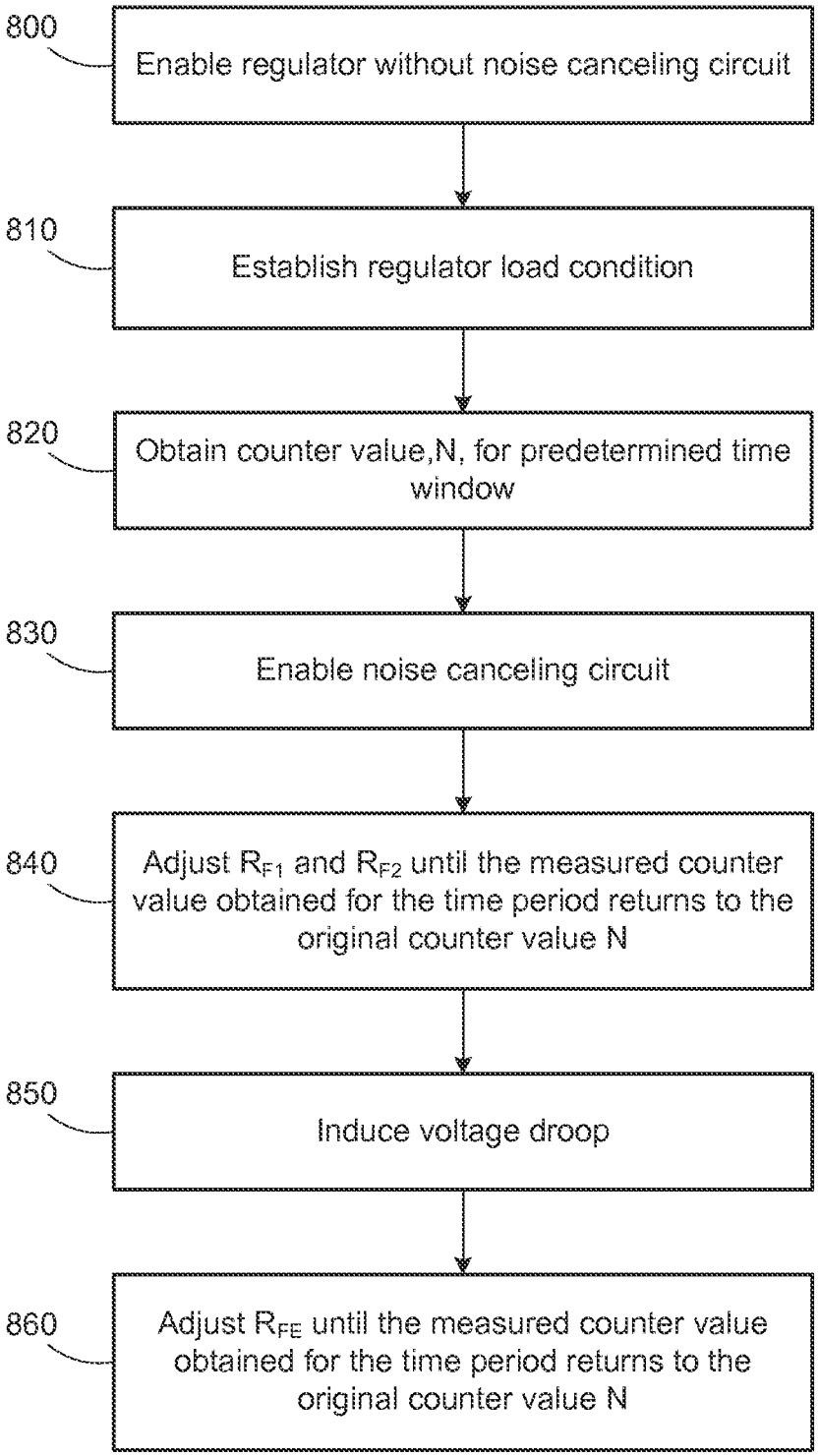
FIG. 8 is a simplified flow diagram of a method for calibrating the voltage regulator of FIG. 3 using the PLL circuit of FIG. 7, according to some embodiments.

FIG. 8 is a simplified flow diagram of a method for calibrating the regulator 300 using the PLL circuit 700 of FIG. 7. In block 800, the regulator 300 is enabled without the noise canceling circuit 365 (i.e., FFE is de-asserted to open the switch 590 shown in FIG. 5). The value of the calibration resistor 430 is set to its minimum value. In block 810, a regulator load condition is established (e.g., start running the VCO 710). In block 820, the counter value, N, obtained for a predetermined time period is determined. In block 830, the noise canceling circuit 365 is enabled (i.e., FFE asserted). With $R_{FE}$ set to its maximum value to minimize feed-forward transconductance gain, $G_{FF}$, to an essentially negligible value, $R_{F1}$ and $R_{F2}$ are adjusted in block 849 until the measured counter value obtained for the time period returns to the original counter value N measured in block 820. In block 850, a voltage droop is induced by increasing the value of the calibration resistor 430. In block 860, the value of $R_{FE}$ is adjusted until the measured counter value returns to original counter value N measured in block 820. Setting $R_{F1}$, $R_{F2}$, and $R_{FE}$ calibrates the regulator 300. The regulator 300 may be re-calibrated periodically or in response to a detected change in the temperature of the circuit.

The regulator 300 provides increased rejection of supply noise and can provide improved performance for circuits that depend on low supply noise to operate. For example, the phase wander of a receiver clock-and-data recovery circuit during periods of long run lengths could be significantly reduced, enabling more efficient data coding schemes to be used. The regulator 300 may be re-calibrated between data transmissions. The topology of the regulator 300 enables very low supply voltage operation, where it is challenging to achieve good PSRR due to voltage headroom issues.

Figure 9:
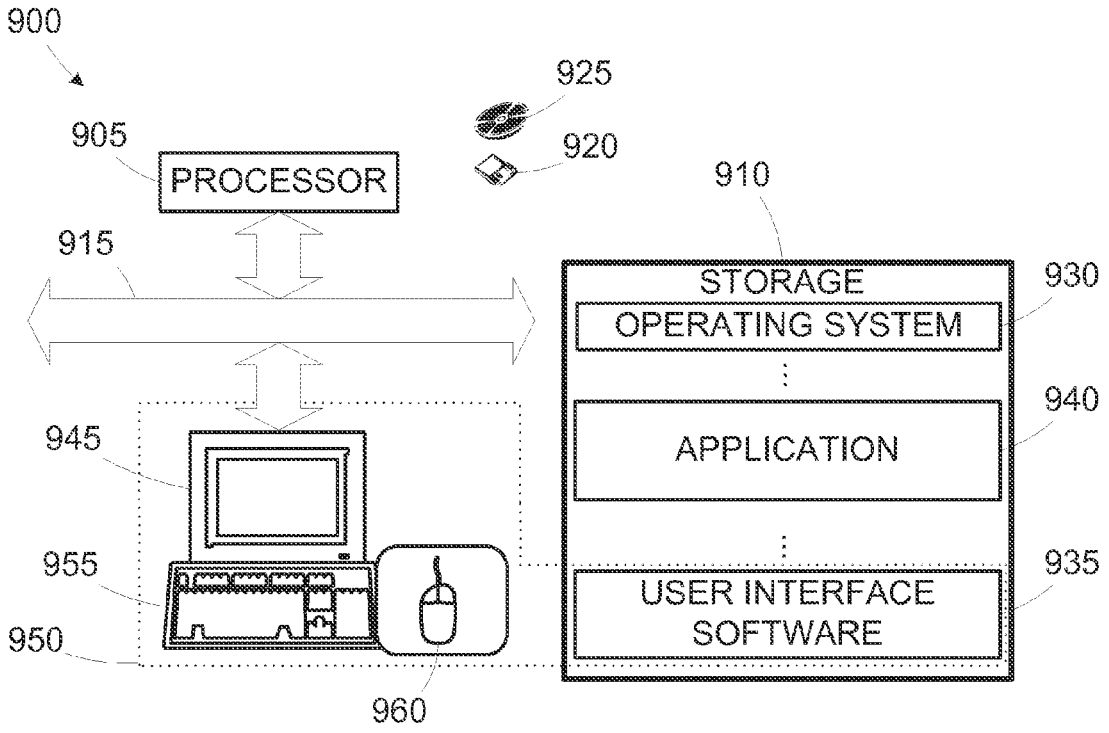
FIG. 9 is a simplified diagram of a computing apparatus that may be programmed to direct the fabrication of the devices of FIG. 3-5 or 7, according to some embodiments.

FIG. 9 illustrates a simplified diagram of selected portions of the hardware and software architecture of a computing apparatus 900 such as may be employed in some aspects of the present subject matter. The computing apparatus 900 includes a processor 905 communicating with storage 910 over a bus system 915. The storage 910 may include a hard disk and/or random access memory (RAM) and/or removable storage, such as a magnetic disk 920 or an optical disk 925. The storage 910 is also encoded with an operating system 930, user interface software 935, and an application 940. The user interface software 935, in conjunction with a display 945, implements a user interface 950. The user interface 950 may include peripheral I/O devices such as a keypad or keyboard 955, mouse 960, etc. The processor 905 runs under the control of the operating system 930, which may be practically any operating system known in the art. The application 940 is invoked by the operating system 930 upon power up, reset, user interaction, etc., depending on the implementation of the operating system 930. The application 940, when invoked, performs a method of the present subject matter. The user may invoke the application 940 in conventional fashion through the user interface 950. Note that although a stand-alone system is illustrated, there is no need for the data to reside on the same computing apparatus 900 as the simulation application 940 by which it is processed. Some embodiments of the present subject matter may therefore be implemented on a distributed computing system with distributed storage and/or processing capabilities.

It is contemplated that, in some embodiments, different kinds of hardware descriptive languages (HDL) may be used in the process of designing and manufacturing very large scale integration circuits (VLSI circuits), such as semiconductor products and devices and/or other types semiconductor devices. Some examples of HDL are VHDL and Verilog/Verilog-XL, but other HDL formats not listed may be used. In some embodiments, the HDL code (e.g., register transfer level (RTL) code/data) may be used to generate GDS data, GDSII data and the like. GDSII data, for example, is a descriptive file format and may be used in different embodiments to represent a three-dimensional model of a semiconductor product or device. Such models may be used by semiconductor manufacturing facilities to create semiconductor products and/or devices. The GDSII data may be stored as a database or other program storage structure. This data may also be stored on a computer readable storage device (e.g., storage 910, disks 920, 925, solid state storage, and the like). In some embodiments, the GDSII data (or other similar data) may be adapted to configure a manufacturing facility (e.g., through the use of mask works) to create devices capable of embodying various aspects of the disclosed embodiments. In other words, in various embodiments, this GDSII data (or other similar data) may be programmed into the computing apparatus 900, and executed by the processor 905 using the application 965, which may then control, in whole or part, the operation of a semiconductor manufacturing facility (or fab) to create semiconductor products and devices. For example, in some embodiments, silicon wafers containing the regulator 300 and/or the PLL 700 illustrated in FIGS. 1-7 may be created using the GDSII data (or other similar data).

The particular embodiments disclosed above are illustrative only, as the disclosed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the disclosed subject matter. Accordingly, the protection sought herein is as set forth in the claims below.

We claim:

1. A voltage regulator, comprising:

a pass element having a control input coupled to a control node and operable to generate an output voltage at an output node;

a negative feedback amplifier operable to receive a reference voltage and the output voltage and generate a signal at the control node based on a difference between the reference voltage and the output voltage; and a noise cancellation circuit coupled to the control node and the output node and operable to generate a bias current at the control node based on the output voltage, wherein the noise cancellation circuit comprises a feed-forward amplifier coupled to the control node and operable to receive a supply voltage and the output voltage and inject a feed-forward current at the control node based on a difference between the supply voltage and the output voltage.

2. The voltage regulator of claim 1, wherein the negative feedback amplifier comprises:

a differential amplifier stage operable to receive the reference voltage and the output voltage; and a common source stage coupled to the differential amplifier stage and operable to generate the signal at the control node.

3. The voltage regulator of claim 1, wherein the noise cancellation circuit further comprises a voltage divider coupled to the supply voltage, wherein the voltage regulator is coupled to the voltage divider to sense the supply voltage.

4. The voltage regulator of claim 3, wherein the voltage divider comprises first and second variable resistors.

5. The voltage regulator of claim 4, wherein the feed-forward amplifier comprises a variable transconductance amplifier.

6. The voltage regulator of claim 5, wherein the noise cancellation circuit further comprises a variable resistor coupled between a supply voltage terminal and the voltage divider.

7. The voltage regulator of claim 5, wherein the variable transconductance amplifier comprises a variable resistor configurable to generate the variable transconductance.

8. A circuit, comprising:

a voltage controlled oscillator operable to generate a clock signal;

a phase detector operable to determine a phase difference between a data signal and the clock signal and control a frequency of the clock signal generated by the voltage controlled oscillator based on the phase difference; and a voltage regulator operable to receive a supply voltage and generate an output voltage for powering the voltage controlled oscillator, the voltage regulator comprising:

a pass element having a control input coupled to a control node and operable to generate an output voltage at an output node;

a negative feedback amplifier operable to receive a reference voltage and the output voltage and generate a signal at the control node based on a difference between the reference voltage and the output voltage; and a noise cancellation circuit coupled to the control node and the output node and operable to generate a bias current at the control node based on the output voltage.

9. The circuit of claim 8, wherein the negative feedback amplifier comprises:

a differential amplifier stage operable to receive the reference voltage and the output voltage; and a common source stage coupled to the differential amplifier stage and operable to generate the signal at the control node.

10. The circuit of claim 8, wherein the noise cancellation circuit comprises a feed-forward amplifier coupled to the control node and operable to receive a supply voltage and the output voltage and inject a feed-forward current at the control node based on a difference between the supply voltage and the output voltage.

11. The circuit of claim 10, wherein the noise cancellation circuit further comprises a voltage divider comprising first and second variable resistors coupled to the supply voltage, the voltage regulator is coupled to the voltage divider to sense the supply voltage, and the circuit further comprises:

a counter operable to count a number of clock cycles in the clock signal over a predetermined time interval; and a controller operable to determine a first value of the counter with the noise cancellation circuit disabled to generate a reference count, and determine resistance values for the first and second variable resistors that result in a second value of the counter equal to the first value with the noise cancellation circuit enabled.

12. The circuit of claim 11, wherein the feed-forward amplifier comprises a variable transconductance amplifier, the noise cancellation circuit further comprises a variable droop resistor coupled between a supply voltage terminal and the voltage divider, and the controller is operable to set the resistance of the variable droop resistor at first value while generating the reference count, set the value of the resistance of the variable droop resistor to a second value, and determine a transconductance value for the feed-forward amplifier that results in a third value of the counter equal to the first value with the noise cancellation circuit enabled and the value of the resistance of the variable droop resistor at the second value.

13. The circuit of claim 12, wherein the variable transconductance amplifier comprises a variable resistor configurable by the controller to generate the variable transconductance.

14. A method, comprising:

enabling a pass element of a voltage regulator, the pass element having a control input coupled to a control node and operable to generate an output voltage at an output node based on a supply voltage;

receiving a reference voltage and the output voltage;

generating a signal at the control node based on a difference between the reference voltage and the output voltage to control the pass element to generate the output voltage; and generating a bias current using a noise cancellation circuit having at least one variable resistor at the control node based on the supply voltage.

15. The method of claim 14, wherein the output node is coupled to a voltage controlled oscillator operable to generate a clock signal, and the method further comprises:

enabling the voltage regulator without enabling the noise cancellation circuit;

establishing a load condition on the voltage regulator;

counting cycles of the clock signal over a first predetermined time interval to generate a reference count;

enabling the noise cancellation circuit; and determining a resistance value for the at least one variable resistor that results in a second value of the count of the clock signal over a second predetermined interval equaling the first value.

16. The method of claim 15, wherein the noise cancellation circuit comprises a feed-forward amplifier coupled to the control node and operable to receive a supply voltage and the output voltage and inject a feed-forward current at the control node based on a difference between the supply voltage and the output voltage and a voltage divider including the at least one variable resistor.

17. The method of claim 16, wherein the voltage divider comprises first and second variable resistors coupled to the supply voltage, the voltage regulator is coupled to the voltage divider to sense the supply voltage, and the method further comprises determining resistance values for the first and second variable resistors that result in the second value of the counts of the clock signal over the second predetermined interval equaling the first value.

18. The method of claim 17, wherein the feed-forward amplifier comprises a variable transconductance amplifier, the noise cancellation circuit further comprises a variable droop resistor coupled between a supply voltage terminal and the voltage divider, and the method further comprises:

setting the resistance of the variable droop resistor at first value while generating the reference count;

setting the value of the resistance of the variable droop resistor to a second value; and determining a transconductance value for the feed-forward amplifier that results in a third value of the count equal to the first value with the noise cancellation circuit enabled and the value of the resistance of the variable droop resistor at the second value.

19. A computer readable storage device encoded with data that, when implemented in a manufacturing facility, adapts the manufacturing facility to create a voltage regulator, comprising:

a pass element having a control input coupled to a control node and operable to generate an output voltage at an output node;

a negative feedback amplifier operable to receive a reference voltage and the output voltage and generate a signal at the control node based on a difference between the reference voltage and the output voltage;

a noise cancellation circuit coupled to the control node and the output node and operable to generate a bias current at the control node based on the output voltage a voltage controlled oscillator operable to receive power form the voltage regulator and generate a clock signal; and a phase detector operable to determine a phase difference between a data signal and the clock signal and control a frequency of the clock signal generated by the voltage controlled oscillator based on the phase difference.

* * * * *